United States Patent [19]

Stepe

[11] 3,967,398

[45] July 6, 1976

[54] DETACHABLE CORNER PROTECTOR FOR WORK IMPLEMENTS

[75] Inventor: Visvaldis A. Stepe, Willow Springs, Ill.

[73] Assignee: Caterpillar Tractor Co., Peoria, Ill.

[22] Filed: Sept. 25, 1975

[21] Appl. No.: 616,788

[52] U.S. Cl. ..... 37/141 R; 37/141 T; 172/719

[51] Int. Cl.[2] ..... A01B 35/32

[58] Field of Search ..... 172/719; 37/141, 142

[56] References Cited

UNITED STATES PATENTS

| | | | |
|---|---|---|---|
| 3,088,232 | 5/1963 | Gilbertson | 37/141 R |
| 3,456,370 | 7/1969 | Gilbertson | 37/141 R |
| 3,469,331 | 9/1969 | Wood | 172/719 X |
| 3,638,736 | 2/1972 | Hahn | 172/719 |
| 3,643,357 | 2/1972 | Benning et al. | 37/141 R |

*Primary Examiner*—Paul E. Shapiro
*Attorney, Agent, or Firm*—Phillips, Moore, Weissenberger Lempio & Strabala

[57] ABSTRACT

A work implement, such as a loader bucket, comprises a pair of laterally spaced end walls and a cutting edge secured forwardly on the bucket, between such end walls. A corner protector is detachably mounted on a forward edge of each of the sidewalls by a plurality of bolts. An interlocking tongue and groove arrangement mounts the corner protector on the sidewall. The corner protector may have a tip mounting adapter formed integrally thereon or may constitute a router bit.

10 Claims, 6 Drawing Figures

22
16
19
15
13
18
23
24'
14
25
25'
24
27
28

15
13a
VI
20a
22a
10a
14
25
VI
31
12
30

DETACHABLE CORNER PROTECTOR FOR WORK IMPLEMENTS

BACKGROUND OF THE INVENTION

This invention relates to means for detachably mounting a protector on a corner of a work implement, such as a loader bucket, bulldozer blade or excavator bucket. The loader bucket, for example, comprises a pair of laterally spaced sidewalls having a forwardly disposed cutting edge secured therebetween. Each corner of the sidewall, adjacent to the cutting edge, is subjected to the highest rate of wear on the bucket and is oftentimes covered by a protector or router bit suitably pinned thereon.

In certain earthworking operations, it is further desirable to mount a hardened digging tooth on each corner of the bucket. A conventional digging tooth or tip is either welded at the corner of the bucket or releasably attached thereto by a plurality of bolts. The welded-on tooth cannot be replaced easily whereas the bolted-on tooth normally requires shear blocks or the like, integrated into the corner of the bucket, to alleviate shearing forces imposed on the bolts during bucket operation. Another disadvantage of the bolted-on tooth is that once it is removed, the mounting surface of the adapter therefor is subjected to wear and thus subsequent fit-up is adversely affected.

SUMMARY OF THIS INVENTION

An object of this invention is to provide an improved and interchangeable protector on the corner of a work implement, such as a loader bucket. The work implement comprises a pair of laterally spaced end walls having a cutting edge extending therebetween and secured forwardly on the work implement. A corner protector, disposed on a forward edge of each of the sidewalls and adjacent to the cutting edge, is slidably mounted on such sidewall in interlocking relationship therewith.

In the preferred embodiment of this invention, the corner protector is mounted on the sidewall by a tongue and groove arrangement whereby the corner protector is prevented from moving forwardly, rearwardly and sidewardly relative to the sidewall. A plurality of bolts are preferably employed to releasably attach the corner protector to the sidewall whereby the corner protector may constitute a router bit, per se, or an integrally combined router bit and a tip-adapter.

BRIEF DESCRIPTION OF THE DRAWINGS

Other objects of this invention will become apparent from the following description and accompanying drawings wherein.

DETAILED DESCRIPTION

Figure 1:
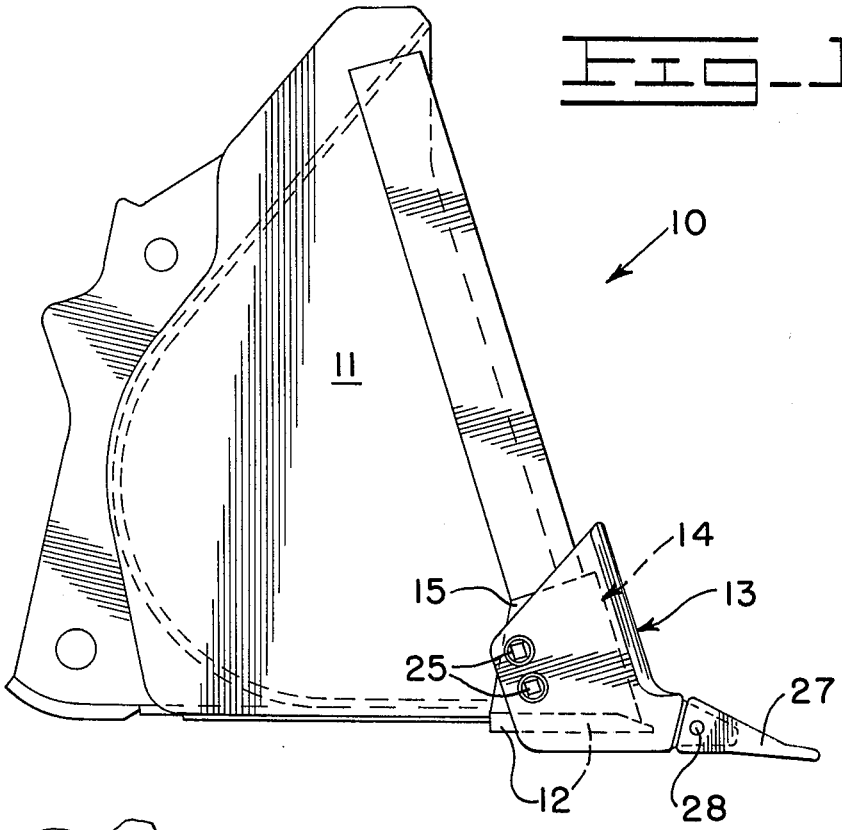
FIG. 1 is a side elevational view of a loader bucket with a combined corner protector and tip-adapter of this invention mounted thereon.

FIG. 1 illustrates a loader bucket 10 comprising a pair of laterally spaced end walls 11 (one shown) having an integral cutting edge 12 disposed forwardly on the bucket to extend between the end walls. A corner protector 13 is disposed on a forward edge 14 of a corner reinforcing plate 15, integrally secured to each sidewall to form a part thereof. It should be understood that the corner protectors may be mounted on the sidewalls of other work implements, such as bulldozer blades, excavator buckets and the like.

Figure 2:
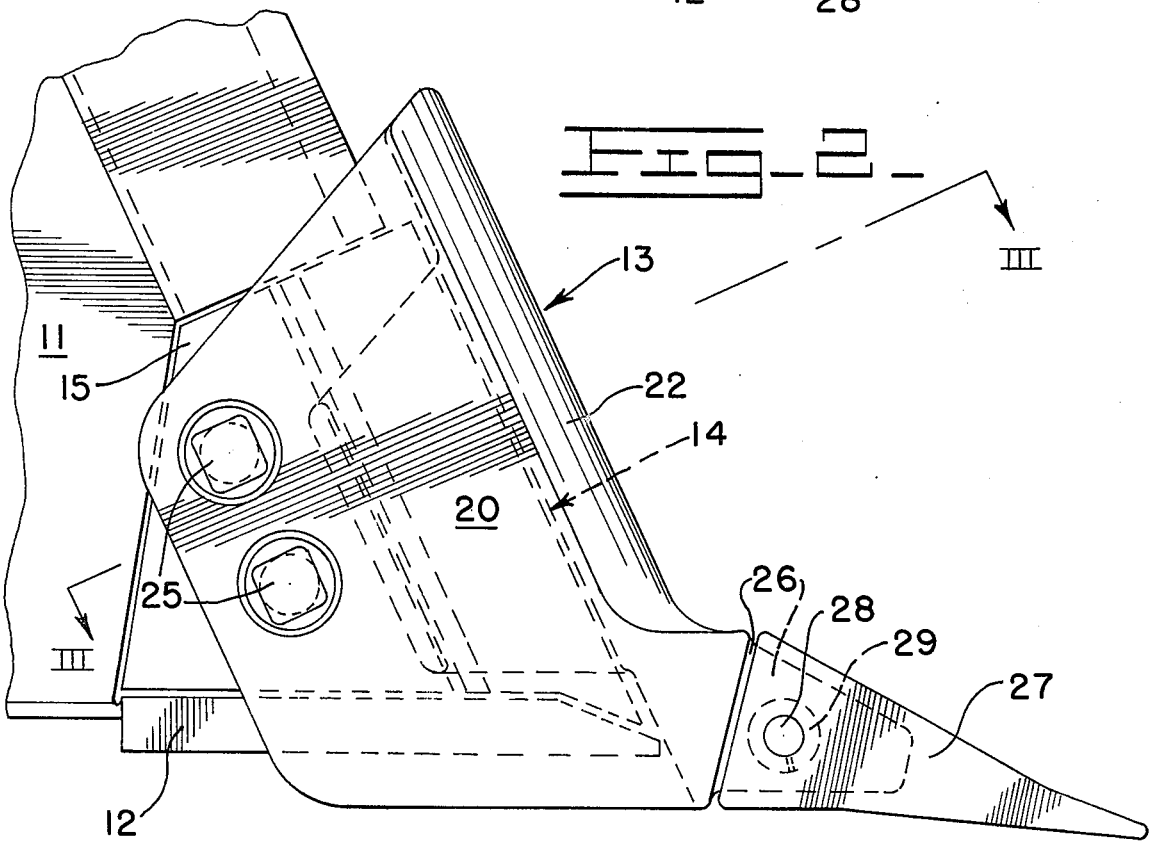
FIG. 2 is an enlarged side elevational view thereof.
Figure 3:
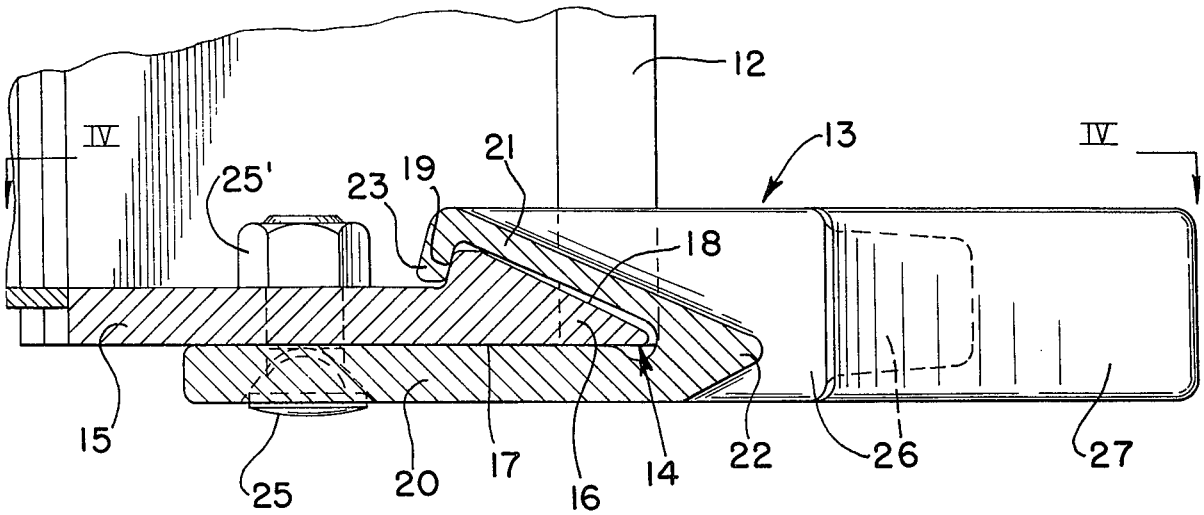
FIG. 3 is a sectional view, taken in the direction of arrows III—III in FIG. 2.
Figure 4:
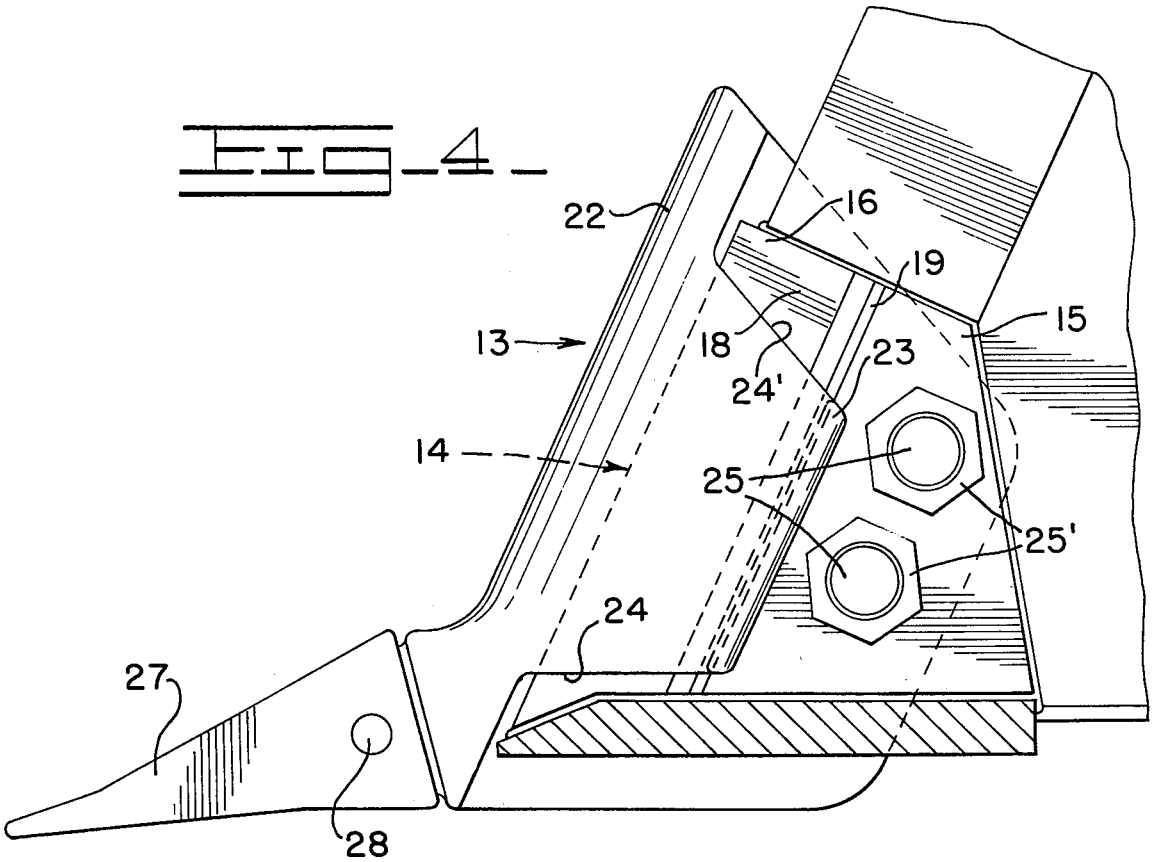
FIG. 4 is a view similar to FIG. 2, but taken in the direction of arrows IV—IV in FIG. 3 to illustrate an inboard side of the corner protector.

Referring to FIGS. 2–4, mounting means for slidably mounting the corner protector in interlocking relationship on the forward edge of the sidewall comprises tongue means 16 defined on such edge by a pair of outboard and inboard surfaces 17 and 18 which converge towards each other in a forward direction. The tongue means is further defined by a bearing surface 19 disposed at a rearward end of surface 18 to extend transversely therefrom towards surface 17. The tongue means thus defines a half-arrow shape when viewed in cross section in FIG. 3.

The mounting means further comprises an elongated groove means defined through the corner protector by a pair of forwardly converging outboard and inboard walls 20, and 21 respectively, which intersect at a forwardly disposed apex 22 of the corner protector. Wall 20 is substantially parallel to closely fitted surface 17 whereas wall 21 preferably converges rearwardly relative to surface 18 (FIG. 3). A strap portion 23 is formed integrally on a rearward end of wall 21 to engage bearing surface 19.

As shown above in FIG. 4, the lower and upper ends 24 and 24' of wall 21 are relieved to facilitate insertion of the corner protector on tongue means 16 by sliding it downwardly thereon. Otherwise stated, the above-described mounting means solely permits the corner protector to be moved linearly along the forward edge of the sidewall. Fastening means preferably comprise a pair of standard countersunk bolts 25 extending transversely through outboard wall 20 and plate 15 to releasably attach the corner protector to the sidewall by nut 25' threaded thereon.

Figure 6:
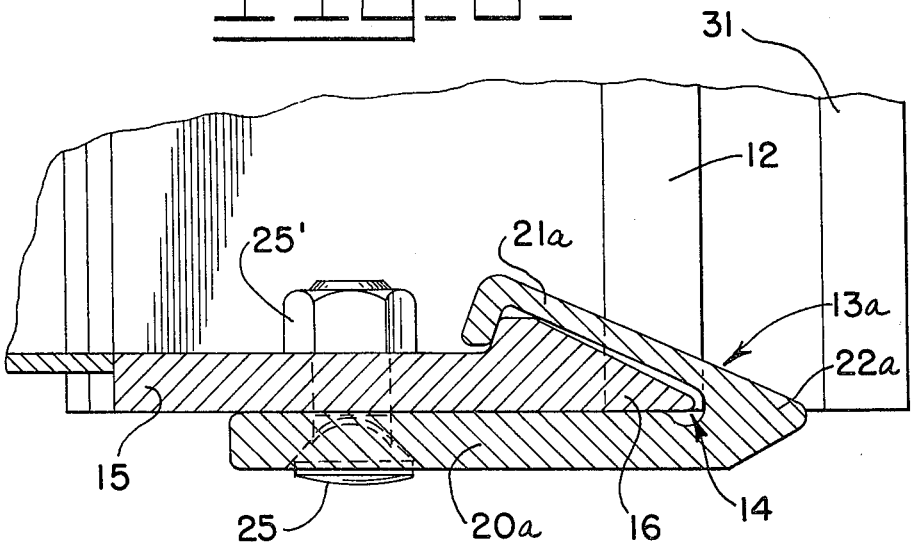
FIG. 6 is a sectional view, taken in the direction of arrows VI—VI in FIG. 5.
Figure 5:
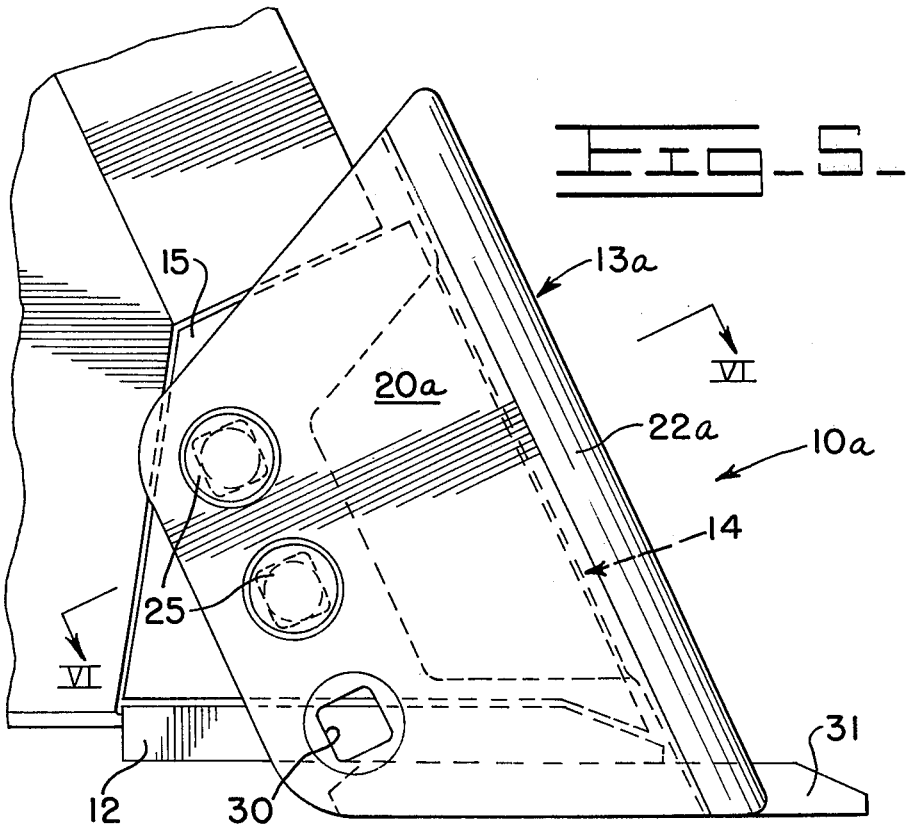
FIG. 5 is a view similar to FIG. 2, but illustrating an alternate corner protector which constitutes a router bit.

In the embodiment illustrated in FIGS. 1–4, an adapter 26 is formed integrally on a forward and lower end of the corner protector. A hardened earthworking tooth or tip 27 is mounted on the adapter by a pin 28. The pin may be held in place by a split washer 29 or the like which frictionally engages the same. FIGS. 5 and 6 illustrate an alternate corner protector **13*a* constituting a router bit adapted to be substituted in lieu of combined corner protector and tip-adapter 13. Identical numerals depict corresponding constructions, but with numerals depicting modified constructions in FIGS. 5 and 6** being accompanied by an "*a*."

Corner protector **13*a* essentially differs from corner protector 13 sidewalls 20*a* and 21*a* and apex 22*a* of the corner protector are substantially straight throughout their length and do not have a tip-adapter integrally secured on a lower end thereof. The above-described tongue and groove type mounting means is also utilized for detachably mounting corner protector 13*a* on a sidewall of the bucket for clean-up operations wherein earthworking tips 27** and not required.

As shown in FIG. 5, a third square bolt receiving aperture 30 is formed through sidewall **20*a* of the corner protector, below bolts 25 and aligned therewith, to adapt it for reversible side-to-side interchange to the other sidewall of such bucket. Such interchange will increase the wear life thereof and also facilitates the use of identical router bits or protective members on both sidewalls of the bucket. In addition, a second cutting edge 31 may be bolted or otherwise suitably secured to an underside of general purpose or first cutting edge 12** to extend forwardly therefrom, if so desired.

Any appreciable amount of top or reverse loading imposed on the above-described protectors will not be transmitted to the bolts. Thus, the number of bolts utilized to attach the protective member to the bucket may be reduced over those required for attaching a corner protector not employing the above described mounting means of this invention therefor. Such is the case, primarily since side loads will be transmitted to the bucket without going through the bolts.

I claim:

1. A work implement comprising a pair of laterally spaced end walls, a cutting edge extending between said end walls and secured forwardly on said work implement, a corner protector disposed on a forward edge of each of said sidewalls and adjacent to said cutting edge, mounting means slidably mounting said corner protector in interlocking relationship on a forward edge of said sidewall by solely permitting said corner protector to be moved linearly along said forward edge and fastening means releasably attaching said corner protector to said sidewall.

2. The work implement of claim 1 wherein said mounting means comprises tongue means formed on the forward edge of said sidewall and elongated groove means defined in said corner protector and interlocked with said tongue means for preventing forward, rearward and sideward movement of said corner protector relative to said sidewall.

3. The work implement of claim 2 wherein said tongue means, when viewed in cross section, comprises a half-arrow shape including a pair of forwardly converging outboard and inboard surfaces and wherein said groove means is defined by a pair of forwardly converging outboard and inboard walls closely fitted over said outboard and inboard surfaces, respectively, and intersecting at an apex disposed forwardly on said corner protector.

4. The work implement of claim 3 wherein said tongue means further comprises a bearing surface disposed at a rearward end of said inboard surface and extending transversely therefrom towards said outboard surface and a strap portion formed on a rearward end of said inboard wall and engaging said bearing surface.

5. The work implement of claim 1 wherein said corner protector has a forwardly projecting adapter secured on a lower end thereof and further comprising a hardened earthworking tip detachably mounted on said adapter.

6. The work implement of claim 5 wherein said fastening means comprises a plurality of bolts extending transversely through an outboard wall of said corner protector and said sidewall.

7. The work implement of claim 6 wherein only two of said bolts releasably attach said corner protector to said sidewall.

8. The work implement of claim 1 wherein a forward edge of said corner protector is at least substantially straight throughout its entire length.

9. The work implement of claim 8 wherein said fastening means comprises a pair of bolts and further comprising a bolt receiving aperture formed through an outboard wall of said corner protector and disposed below said pair of bolts and aligned therewith.

10. The work implement of claim 8 further comprising another cutting edge secured to said first-mentioned cutting edge and extending forwardly therefrom.

* * * * *